US011959030B2

(12) United States Patent
Weiss et al.

(10) Patent No.: US 11,959,030 B2
(45) Date of Patent: Apr. 16, 2024

(54) PROCESS FOR THE PREPARATION OF OLEFINS, COMPRISING HYDROTREATMENT, DE-ASPHALTING, HYDROCRACKING AND STEAM CRACKING

(71) Applicant: IFP Energies Nouvelles, Rueil-Malmaison (FR)

(72) Inventors: Wilfried Weiss, Rueil-Malmaison (FR); Isabelle Merdrignac, Rueil-Malmaison (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 200 days.

(21) Appl. No.: 17/626,548

(22) PCT Filed: Jul. 6, 2020

(86) PCT No.: PCT/EP2020/069036
§ 371 (c)(1),
(2) Date: Jan. 12, 2022

(87) PCT Pub. No.: WO2021/008924
PCT Pub. Date: Jan. 21, 2021

(65) Prior Publication Data

US 2022/0380690 A1 Dec. 1, 2022

(30) Foreign Application Priority Data

Jul. 17, 2019 (FR) ..... 1908079

(51) Int. Cl.
*C10G 67/04* (2006.01)
*C10G 7/06* (2006.01)
(Continued)

(52) U.S. Cl.
CPC ..... *C10G 67/0409* (2013.01); *C10G 7/06* (2013.01); *C10G 9/36* (2013.01); *C10G 21/003* (2013.01);
(Continued)

(58) Field of Classification Search
CPC ..... C10G 67/0409; C10G 7/06; C10G 9/36; C10G 21/003; C10G 21/14; C10G 45/16;
(Continued)

(56) References Cited

U.S. PATENT DOCUMENTS

2010/0300932 A1 12/2010 Debuisschert et al.
2016/0362618 A1 12/2016 Oprins et al.
2017/0369796 A1* 12/2017 Le Coz ..... C10G 69/04

FOREIGN PATENT DOCUMENTS

EP 2256179 A2 12/2010
FR 3053047 A1 12/2017

OTHER PUBLICATIONS

International Search Report dated Aug. 7, 2020 issued in corresponding PCT/EP2020/069036 application (2 pages).

* cited by examiner

*Primary Examiner* — Randy Boyer
*Assistant Examiner* — Juan C Valencia
(74) *Attorney, Agent, or Firm* — MILLEN, WHITE, ZELANO & BRANIGAN, P.C.; Brion P. Heaney

(57) ABSTRACT

The present invention relates to a process for producing olefins from a hydrocarbon feedstock 11 with a sulfur content of at least 0.1 weight %, an initial boiling point of at least 180° C. and a final boiling point of at least 600° C.

15 Claims, 1 Drawing Sheet

(51) Int. Cl.

| | |
|---|---|
| ***C10G 9/36*** | (2006.01) |
| ***C10G 21/00*** | (2006.01) |
| ***C10G 21/14*** | (2006.01) |
| ***C10G 45/16*** | (2006.01) |
| ***C10G 47/00*** | (2006.01) |

(52) U.S. Cl.
CPC ..... *C10G 21/14* (2013.01); *C10G 45/16* (2013.01); *C10G 47/00* (2013.01); *C10G 2300/202* (2013.01); *C10G 2300/301* (2013.01); *C10G 2300/4006* (2013.01); *C10G 2300/4012* (2013.01); *C10G 2300/4018* (2013.01); *C10G 2300/44* (2013.01); *C10G 2400/20* (2013.01)

(58) Field of Classification Search
CPC ..... C10G 47/00; C10G 2300/202; C10G 2300/301; C10G 2300/4006; C10G 2300/4012; C10G 2300/4018; C10G 2300/44; C10G 2400/20; C10G 45/02; C10G 65/12; C10G 67/0454; C10G 69/06
See application file for complete search history.

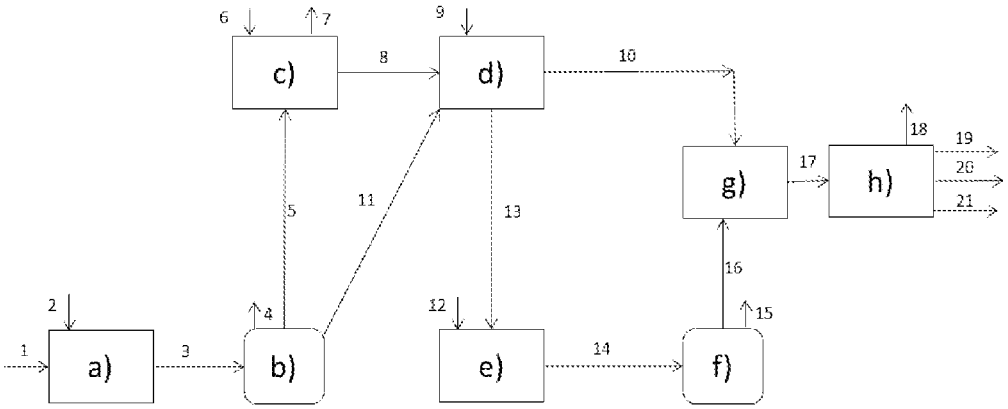
1
2
a)
3
4
b)
5
6
7
c)
8
9
d)
10
11
12
e)
13
14
f)
15
16
g)
17
18
h)
19
20
21

PROCESS FOR THE PREPARATION OF OLEFINS, COMPRISING HYDROTREATMENT, DE-ASPHALTING, HYDROCRACKING AND STEAM CRACKING

TECHNICAL FIELD

The present invention relates to a process for producing olefins from heavy hydrocarbon fractions whose constituents include sulfur impurities, metals and asphaltenes.

PRIOR ART

The improvement in engines and the progressive electrification of a part of the vehicle stock have driven a change in the demand for petroleum products, with a tendency to reduce the growth in the demand for motor fuels. Conversely, the growth in the demand for primary petrochemicals and particularly for olefins is more sustained. Ethylene and propylene, for example, are olefins which are highly sought after, since they are essential intermediates for numerous petrochemical products such as polyethylene or polypropylene. There is therefore an advantage in further integrating the existing refining sites and petrochemical sites, in remodelling the refining sites so as to produce, at least partly, primary petrochemicals, or in designing new integrated refining-petrochemistry systems, or else in designing sites where the majority or all of the crude is converted into primary petrochemicals.

The main process enabling the conversion of heavy hydrocarbon fractions into olefins in high yield is that of steam cracking. The production of the desired olefins is accompanied by co-products, notably aromatic compounds and pyrolysis oil, which require purification steps. Moreover, the selectivity for desired olefins is heavily dependent on the quality of the feedstocks introduced into the steam cracking step. There is therefore an advantage in identifying new processes enabling the production of olefins from heavy hydrocarbon fractions in a way which is more efficient, profitable, and independent of the heavy hydrocarbon fraction treated.

Advantageously, the process of the invention allows optimization of the properties of the fractions to be introduced into the steam cracking step, and hence maximization of the yields of olefins of interest during the steam cracking step.

In the processes for treating heavy hydrocarbon fractions, the hydrotreating of residue in a fixed bed allows some of the contaminants of the feedstock to be removed, notably the metals, sulfur and asphaltenes.

It is also known practice to perform deasphalting operations. Deasphalting enables the separation of an asphaltene-rich asphalt fraction, referred to as pitch, from a deasphalted oil fraction, referred to as DAO for "DeAsphalted Oil", with a greatly reduced asphaltene content, thereby facilitating its profitable exploitation by catalytic cracking or hydrocracking.

The conversion products and more particularly the heavy fractions obtained from conversion processes, such as deasphalted oils and vacuum distillates, are difficult to treat directly in a steam cracking step. The presence of high levels of naphthenic and aromatic compounds leads to a sharp drop in the yields of olefins of interest, a rise in the yield of pyrolysis oil, and increased coking of the tubes of the steam cracking furnaces, which is detrimental to operability. It is therefore necessary to enhance the operability of the steam cracking step in order to produce olefins with a good yield.

The present invention aims to overcome the problems set out above, and notably to provide a process which allows flexible production of olefins and optimized production from heavy hydrocarbon feedstocks, so as to enhance the profitability of the olefin production process.

Accordingly, the Applicant has developed a new process for producing olefins, comprising an ebullated-bed residue hydroconversion step, a deasphalting step for producing a DAO fraction and an asphalt fraction, a fixed-bed hydrocracking step, an extraction step for producing a raffinate and a fraction rich in aromatics, and a step of steam cracking of said raffinate.

The process of the present invention features the following advantages:

- the profitable exploitation of heavy fractions to produce essential petrochemical intermediates,
- production of olefins from heavy fractions in a good yield,
- a reduction in the cost of olefin production,
- flexibility of the process, enabling the treatment of all heavy hydrocarbon fractions irrespective of their origin,
- the sequencing of a residue hydroconversion step and a deasphalting step, enabling thorough conversion of the residual fraction and notably of the asphaltenes,
- the limitation of coking during said steam cracking step.

SUMMARY OF THE INVENTION

The subject of the present invention relates to a process for producing olefins from a hydrocarbon feedstock 1 with a sulfur content of at least 0.1 weight %, an initial boiling point of at least 180° C. and a final boiling point of at least 600° C., said process comprising the following steps:

a) a hydroconversion step performed in an ebullated-bed reactor, in which said heavy hydrocarbon feedstock 1 is contacted, in the presence of hydrogen 2, with a hydroconversion catalyst, said step enabling the production of an effluent 3;

b) a step of separation of the effluent 3 obtained from the hydroconversion step a) into a gaseous fraction 4, a fraction 11 comprising compounds with a boiling point of between 350 and 540° C., and a liquid vacuum residue fraction 5 comprising compounds with a boiling point of at least 540° C., c) a deasphalting step by liquid-liquid extraction of the vacuum residue fraction 5 obtained from the separation step b), said step c) being implemented by means of a solvent 6 or a mixture of solvents, enabling production, on the one hand, of an asphalt-comprising fraction 7 and, on the other hand, of a deasphalted oil fraction 8, d) a step of extraction of the aromatics from at least part of the deasphalted oil fraction 8 obtained from the deasphalting step c) and from at least part of the fraction 11 obtained from the separation step b), enabling the production of an extract fraction 13 and a raffinate fraction 10, e) a step e) of fixed-bed hydrocracking of at least part of the extract fraction 13 obtained from the extraction step d) in the presence of hydrogen 12 and of a hydrocracking catalyst, enabling the production of an effluent 14, f) a step of separation of the effluent 14 obtained from the fixed-bed hydrocracking step e) into at least one gaseous fraction 15 and at least one liquid fraction 16, g) a step g) of steam cracking of the raffinate fraction 10 obtained from the extraction step d) and of the liquid fraction 16 obtained from the separation step f), including compounds with a boiling point of less than or equal to 350° C., enabling the production of an effluent 17, h) a step of separation of the effluent 17 obtained from the steam cracking step g), enabling the production of at least one hydrogen-comprising fraction 18, an ethylene-comprising fraction 19, a propylene-comprising fraction 20 and a fraction 21 comprising pyrolysis oil.

In a preferred embodiment, the separation step b) comprises a vacuum distillation, enabling the production of at least one vacuum distillate fraction 11 and at least one vacuum residue fraction 5.

In a preferred embodiment, the separation step b) comprises, upstream of the vacuum distillation, an atmospheric distillation, enabling the production of at least one atmospheric distillate fraction and at least one atmospheric residue fraction, said atmospheric residue fraction being sent into said vacuum distillation, enabling the production of at least one vacuum distillate fraction 11 and at least one vacuum residue fraction 5.

In a preferred embodiment, all of the residue fraction 5 obtained from step b) is sent to the deasphalting step c).

In a preferred embodiment, the solvent 6 used in step c) is an apolar solvent composed of at least 80% by volume of saturated hydrocarbon(s) comprising a carbon number of between 3 and 7.

In a preferred embodiment, at least part of a distillate fraction obtained from the separation step b) is introduced into the aromatics extraction step d).

In a preferred embodiment, the aromatics extraction step d) is performed on fractions with a boiling point of greater than or equal to 180° C.

In a preferred embodiment, the compounds extracted during step d) have a boiling point greater than the boiling point of the solvent 6 used.

In a preferred embodiment, the hydrocracking step e) is performed so as to produce a yield of liquid compounds with a boiling point of less than 220° C. of more than 50% by weight of the feedstock entering the hydrocracking step e).

In a preferred embodiment, the separation step f) comprises at least one atmospheric distillation, enabling the production of at least one atmospheric distillate fraction 16 including compounds with a boiling point of less than 350° C., and a liquid fraction comprising vacuum distillate including compounds with a boiling point of greater than 350° C.

In a preferred embodiment, the atmospheric distillate fraction 16 and the fraction comprising vacuum distillate are sent to the steam cracking step g).

In a preferred embodiment, part of a fraction comprising compounds with a boiling point of between 80 and 180° C. obtained from the separation step b) is introduced into the steam cracking step g).

In a preferred embodiment, the steam cracking step g) is performed in at least one pyrolysis furnace at a temperature of between 700 and 900° C., under a pressure of between 0.05 and 0.3 MPa for a residence time of less than or equal to 1.0 second.

In a preferred embodiment, the cuts rich in saturated compounds which are obtained from the light gases or from the pyrolysis gasoline obtained from the separation step h) may be recycled into the steam cracking step g).

In a preferred embodiment, the pyrolysis oil fraction 21 is subjected to an additional separation step so as to obtain a light pyrolysis oil, comprising compounds with a boiling point of less than 350° C., and a heavy pyrolysis oil, comprising compounds with a boiling point of greater than 350° C. Said light pyrolysis oil is injected upstream of the hydrocracking step e) and said heavy pyrolysis oil is injected upstream of the hydroconversion step a) and/or of the deasphalting step c).

LIST OF FIGURES

FIG. 1 represents a sequence of the process according to the invention.

DESCRIPTION OF THE EMBODIMENTS

It is specified that, throughout this description, the expression "between . . . and . . . ", "less than . . . " or "greater than" should be understood as including the limits stated.

For the purposes of the present invention, the various embodiments presented may be used alone or in combination with each other, without any limit to the combinations.

In the remainder of the description, reference is made to FIG. 1, which illustrates an example of implementation of the process for producing olefins from heavy hydrocarbon feedstocks according to the invention. The indication of the elements referenced in FIG. 1 in the remainder of the description enables better understanding of the invention, without said invention being limited to the particular example illustrated in FIG. 1.

As represented in FIG. 1, the process according to the invention comprises the following steps:

- a step a) of hydroconversion of the heavy hydrocarbon feedstock 1 in the presence of a hydrogen-rich gas 2 in at least one ebullated-bed reactor including a hydroconversion catalyst;
- a step b) of separation of the effluent 3 obtained from the hydroconversion step a), enabling the production of at least one hydrogen-comprising fraction 4, a liquid fraction 11 containing compounds with a boiling point of between 350 and 540° C. and a heavy liquid fraction 5 containing compounds with a boiling point of greater than 540° C.;
- a step c) of deasphalting of the fraction 5 obtained from the separation step b), as a mixture with a solvent or a combination of solvents 6, enabling the production of at least one fraction including deasphalted oil (DAO) 8, and a fraction 7 including asphalt;
- a step d) of extracting at least part of the fraction 8 including deasphalted oil (DAO) obtained from the deasphalting step c) and at least part of the fraction 11 obtained from the separation step b), with a solvent or a combination of solvents 9, enabling the production of at least one fraction 10 rich in saturated compounds (raffinate), and a fraction 13 rich in aromatic compounds (extract);
- a step e) of hydrocracking in the presence of a hydrogen-rich gas 12 and of at least part of the aromatics-rich fraction 13 obtained from the extraction step d), performed in at least one fixed-bed reactor including a hydrocracking catalyst;
- a step f) of separation of the effluent 14 obtained from the hydrocracking step e), enabling the production of at least one hydrogen-comprising gas fraction 15, and a liquid fraction 16 comprising compounds with a boiling point of less than 350° C.;
- a step g) of steam cracking of the raffinate fraction 10 obtained from the extraction step d) and of the liquid fraction 16 containing compounds with a boiling point of less than 350° C., obtained from the separation step f);

a step h) of separation of the effluent 17 obtained from the steam cracking step g), enabling the recovery of at least one hydrogen-comprising fraction 18, an ethylene-comprising fraction 19, a propylene-comprising fraction 20 and a fraction 21 comprising pyrolysis oil.

The above description of FIG. 1 is an example of implementation of the invention, which does not in any way limit the invention. Only the main steps are represented in said figures, but it is understood that all the equipment required for operation is present (drums, pumps, exchangers, ovens, columns, etc.). Only the main streams containing the hydrocarbons are represented, but it is understood that hydrogen-rich gas streams (top-up or recycle) can be injected at the inlet of each catalytic reactor or bed or between two catalytic reactors or beds. Means well known to those skilled in the art for purifying and recycling hydrogen are also used. The hydrogen produced during the steam cracking step is advantageously used to top up the hydroconversion step a) and/or the hydrocracking step d).

According to a variant not shown, at least part of the pyrolysis oil fraction 21 obtained from the separation step h) may be injected upstream of the deasphalting step c) and/or of the hydrocracking step d). Advantageously, this variant enables the elimination of the asphaltenes contained in the pyrolysis oil and hence the maximization of olefin production.

According to a variant not shown, the pyrolysis oil fraction 21 obtained from the separation step h) may be separated into at least two fractions, for example into a light pyrolysis oil fraction which is sent at least partly to the hydrocracking step d), and a heavy pyrolysis oil fraction which is sent at least partly to the hydroconversion step a) and/or the deasphalting step c). Advantageously, this variant enables further maximization of olefin production.

According to a variant not shown, step b) of separation of the effluent 3 obtained from the hydrotreating step a) enables the production also of an atmospheric distillate fraction comprising compounds with a boiling point of between 180 and 350° C., which may be introduced at least partly into the aromatics extraction step d).

The feedstock treated and the various steps of the process of the invention are now described in greater detail below.

The Feedstock

The heavy hydrocarbon feedstock 1 treated in the process of the invention is advantageously a hydrocarbon feedstock containing asphaltenes, and in particular having a C7 asphaltene content of at least 1.0 weight %, preferably of at least 2.0 weight %, relative to the weight of the feedstock.

The feedstock 1 has an initial boiling point of at least 180° C., preferably of at least 350° C. and more preferably of at least 540° C., and a final boiling point of at least 600° C.

The hydrocarbon feedstock 1 according to the invention may be selected from atmospheric residues, vacuum residues obtained from direct distillation, crude oils, topped crude oils, bituminous sands or derivatives thereof, bituminous schists or derivatives thereof, and source rock oils or derivatives thereof, taken alone or as a mixture. In the present invention, the feedstocks treated are preferably atmospheric residues or vacuum residues, or mixtures of these residues, and more preferentially vacuum residues.

The heavy hydrocarbon feedstock treated in the process may contain, inter alia, sulfur impurities. The sulfur content may be at least 0.1% by weight, at least 0.5% by weight, preferably at least 1.0% by weight, more preferably at least 2.0% by weight, relative to the weight of the feedstock.

The heavy hydrocarbon feedstock treated in the process may contain, inter alia, metals. The nickel and vanadium content may be at least 20 ppm, preferably at least 50 ppm, relative to the weight of the feedstock.

The heavy hydrocarbon feedstock treated in the process may contain, inter alia, Conradson carbon. The Conradson carbon content may be at least 2.0 weight %, preferably at least 5.0 weight %, relative to the weight of the feedstock.

These feedstocks may advantageously be used as they are. Alternatively, said feedstocks may be blended with at least one co-feedstock.

Preferably a plurality of co-feedstocks may be used in various steps of the process of the invention so as to modify the viscosity of the feedstock introduced at each of the steps. A co-feedstock may be introduced upstream of at least one reactor of the hydroconversion step a). This co-feedstock may be a hydrocarbon fraction or a mixture of lighter hydrocarbon fractions, which may preferably be selected from products obtained from a fluid-bed catalytic cracking (FCC or Fluid Catalytic Cracking) process, in particular a light cut (LCO or Light Cycle Oil), a heavy cut (HCO or Heavy Cycle Oil), a decanted oil, an FCC residue. This co-feedstock may also be an atmospheric diesel oil fraction or a vacuum diesel oil fraction, obtained by atmospheric or vacuum distillation of a crude oil or of an effluent from a conversion process such as coking or visbreaking, or obtained from separation steps c) and/or e). This co-feedstock does not represent more than 20% by weight of the heavy hydrocarbon feedstock 1.

Hydroconversion Step a)

In accordance with the invention, a hydroconversion step a) is performed in an ebullated-bed reactor in which the heavy hydrocarbon feedstock 1 or the mixture of feedstocks is contacted, in the presence of hydrogen, with a hydroconversion catalyst. Advantageously, the feedstock or the mixture of feedstocks is introduced into step a) in the presence of a co-feedstock.

The term "hydroconversion" refers to all of the reactions performed for reducing the size of the molecules, mainly by cleaving carbon-carbon bonds, by the action of hydrogen in the presence of a catalyst. Hydrotreating and hydrocracking reactions notably take place during the hydroconversion step.

Preferably, the hydroconversion step comprises one or more three-phase reactors with upflow of liquid and of gas containing at least one hydroconversion catalyst, the ebullated-bed reactors, which may be in series and/or in parallel, typically functioning with the aid of the technology and under the conditions of the H-Oil™ process as described, for example, in U.S. Pat. Nos. 4,521,295, 4,495,060, 4,457,831 or 4,354,852, or in the article AIChE, Mar. 19-23, 1995, Houston, Texas, paper number 46d, "Second generation ebullated bed technology", or in chapter 3.5 "Hydroprocessing and Hydroconversion of Residue Fractions" from the book "Catalysis by Transition Metal Sulfides", published by Editions Technip in 2013. Each reactor advantageously includes a recirculation pump which makes it possible to maintain the catalyst in an ebullated bed by continuous recycling of at least a portion of a liquid fraction advantageously withdrawn at the top of the reactor and reinjected at the bottom of the reactor.

The hydroconversion step a) is performed under conditions enabling the production of a liquid effluent with a reduced content of sulfur, Conradson carbon, metals and nitrogen.

Advantageously, step a) is preferably performed under an absolute pressure of between 2 MPa and 38 MPa, more preferentially between 5 MPa and 25 MPa and even more preferably between 6 MPa and 20 MPa, at a temperature of between 300° C. and 550° C., more preferentially of between 350° C. and 500° C. and preferably of between 370° C. and 450° C. The hourly space velocity (HSV) relative to the volume of each three-phase reactor is preferably between 0.05 $h^{-1}$ and 10 $h^{-1}$. According to one preferred embodiment, the HSV is between 0.1 $h^{-1}$ and 10 $h^{-1}$, more preferentially between 0.1 $h^{-1}$ and 5.0 $h^{-1}$ and more preferably still between 0.15 $h^{-1}$ and 2.0 $h^{-1}$. According to another embodiment, the HSV is between 0.05 $h^{-1}$ and 0.09 $h^{-1}$. The amount of hydrogen mixed with the feedstock is preferably between 50 and 5000 normal cubic metres ($Nm^3$) per cubic metre ($m^3$) of liquid feedstock, preferably between 100 and 2000 $Nm^3/m^3$ and very preferably between 200 and 1000 $Nm^3/m^3$.

The hydroconversion catalyst used in the hydroconversion step a) of the process according to the invention may contain one or more elements from groups 4 to 12 of the Periodic Table of the Elements, which may or may not be deposited on a support. Use may advantageously be made of a catalyst comprising a support, preferably an amorphous support, such as silica, alumina, silica/alumina, titanium dioxide or combinations of these structures, and very preferably alumina.

The catalyst may contain at least one non-noble metal from group VIII chosen from nickel and cobalt, preferably nickel, said element from group VIII preferably being used in combination with at least one metal from group VIB chosen from molybdenum and tungsten; preferably, the metal from group VIB is molybdenum.

In the present description, the groups of chemical elements are given according to the CAS classification (CRC Handbook of Chemistry and Physics, published by CRC Press, Editor in Chief D. R. Lide, 81st edition, 2000-2001). For example, group VIII according to the CAS classification corresponds to the metals of columns 8, 9 and 10 according to the new IUPAC classification.

Advantageously, the hydroconversion catalyst used in the hydroconversion step a) comprises an alumina support and at least one metal from group VIII chosen from nickel and cobalt, preferably nickel, and at least one metal from group VIB chosen from molybdenum and tungsten, preferably molybdenum. Preferably, the hydroconversion catalyst comprises nickel as element from group VIII and molybdenum as element from group VIB.

The content of non-noble metal from group VIII, in particular of nickel, is advantageously between 0.5% and 10.0%, expressed as weight of metal oxide (in particular of NiO), and preferably between 1.0% and 6.0% by weight, and the content of metal from group VIB, in particular of molybdenum, is advantageously between 1.0% and 30%, expressed as weight of metal oxide (in particular of molybdenum trioxide $MoO_3$), and preferably between 4% and 20% by weight. The contents of metals are expressed as weight percentage of metal oxide relative to the weight of the catalyst.

This catalyst is advantageously used in the form of extrudates or of beads. The beads have, for example, a diameter of between 0.4 mm and 4.0 mm. The extrudates have, for example, a cylindrical form with a diameter of between 0.5 and 4.0 mm and a length of between 1.0 and 5.0 mm. The extrudates may also be objects of a different shape such as trilobes, regular or irregular tetralobes, or other multilobes. Catalysts of other forms may also be used.

The size of these various forms of catalysts may be characterized by means of the equivalent diameter. The equivalent diameter is defined as six times the ratio between the volume of the particle and the external surface area of the particle. The catalyst used in the form of extrudates, beads or other forms thus has an equivalent diameter of between 0.4 mm and 4.4 mm. These catalysts are well known to those skilled in the art.

In one of the embodiments of the process according to the invention, a different hydroconversion catalyst is used in each reactor of this initial hydroconversion step ($a_1$), the catalyst proposed for each reactor being suited to the feedstock sent to this reactor.

In one of the embodiments of the process according to the invention, several types of catalysts are used in each reactor.

In one of the embodiments of the process according to the invention, each reactor contains one or more catalysts that are suitable for ebullated-bed operation.

As is known, and described, for example, in patent FR 3 033 797, when it is spent, the hydroconversion catalyst may be partly replaced with fresh catalyst, and/or with spent catalyst which has higher catalytic activity than the spent catalyst to be replaced, and/or with regenerated catalyst, and/or with rejuvenated catalyst (catalyst obtained from a rejuvenation zone in which the majority of the deposited metals are removed, before sending the spent rejuvenated catalyst to a regeneration zone in which the carbon and sulfur it contains are removed, thus increasing the activity of the catalyst), by withdrawing the spent catalyst preferably at the bottom of the reactor, and by introducing replacement catalyst either at the top or at the bottom of the reactor. This replacement of spent catalyst is preferably performed at regular time intervals, and preferably portionwise or virtually continuously. The replacement of spent catalyst may be totally or partly done with spent and/or regenerated and/or rejuvenated catalyst obtained from the same reactor and/or from another reactor of any hydroconversion step. The catalyst may be added with the metals in the form of metal oxides, with the metals in the form of metal sulfides, or after preconditioning. For each reactor, the degree of replacement of the spent hydroconversion catalyst with fresh catalyst is advantageously between 0.01 kg and 10 kg per cubic metre of feedstock treated and preferably between 0.1 kg and 3 kg per cubic metre of feedstock treated. This withdrawing and this replacement are performed using devices which advantageously permit continuous functioning of this hydroconversion step.

As regards the at least partial replacement with regenerated catalyst, it is possible to send the spent catalyst withdrawn from the reactor to a regeneration zone, in which the carbon and the sulfur which it contains are removed, and then to return this regenerated catalyst to the hydroconversion step. As regards the at least partial replacement with rejuvenated catalyst, it is possible to send the spent catalyst withdrawn from the reactor to a rejuvenation zone, in which most of the metals deposited are removed, before sending the spent and rejuvenated catalyst to a regeneration zone, in which the carbon and the sulfur which it contains are removed, and then to return this regenerated catalyst to the hydroconversion step a).

The hydroconversion step a) is characterized by a degree of conversion of the compounds boiling above 540° C. of greater than 50% by mass, preferably greater than 70% by mass.

The effluent 3 obtained on conclusion of the hydroconversion step a) comprises at least one heavy liquid fraction 5, also called residue liquid fraction, and a gaseous fraction 4 containing gases, notably $H_2$, $H_2S$, $NH_3$, and $C_1$-$C_4$ hydrocarbons (in other words those comprising from 1 to 4 carbon atoms).

Separation Step b)

In accordance with the invention, the process comprises a step b) of separation of the effluent 3 obtained from the hydroconversion step a) into a gaseous fraction 4, a fraction 11 comprising compounds with a boiling point of between 350 and 540°, and at least one liquid residue fraction 5 comprising compounds with a boiling point of at least 540° C.

The gaseous fraction 4 may be separated from the effluent 3 using separation devices well known to those skilled in the art, in particular using one or more disengagers which may operate at different pressures and temperatures, optionally in combination with a hydrogen or steam stripping means and with one or more distillation columns. After optional cooling, this gaseous fraction 4 is preferably treated in a hydrogen purification means, to recover the hydrogen not consumed during the hydroconversion reactions.

The purified hydrogen may then advantageously be recycled into the process according to the invention. The hydrogen may be recycled into the inlet and/or into various points of the hydroconversion step a) and/or of the ebullated-bed hydrocracking step d).

The separation step b) comprises a vacuum distillation in which the effluent 3 obtained from step a) is fractionated by vacuum distillation into at least one vacuum distillate fraction 11 and at least one vacuum residue fraction 5. The vacuum distillate fraction 11 comprises vacuum gas oil fractions, these being compounds with a boiling point of between 350 and 540° C. The heavy liquid fraction 5 is preferably a liquid hydrocarbon fraction containing at least 80% of compounds with a boiling point of greater than or equal to 540° C.

The separation step b) preferably comprises, first of all, an atmospheric distillation, meaning a distillation upstream of the vacuum distillation, in which the liquid hydrocarbon fraction(s) obtained after separation are fractionated by atmospheric distillation into at least one atmospheric distillate fraction and at least one atmospheric residue fraction, then a vacuum distillation in which the atmospheric residue fraction obtained after atmospheric distillation is fractionated by vacuum distillation into at least one vacuum distillate fraction 11 and at least one vacuum residue fraction 5.

Advantageously, the separation step b) also comprises at least one atmospheric distillation upstream of the vacuum distillation, in which the effluent 3 is fractionated by atmospheric distillation into at least one distillate fraction containing naphtha, in other words comprising compounds with a boiling point of between 80 and 180° C., and a distillate fraction containing diesel, in other words comprising compounds with a boiling point of between 180 and 350° C.

Advantageously, the distillate fraction containing naphtha is at least partly and preferably entirely sent to the steam cracking step g). The distillate fraction containing diesel may be at least partly and preferably entirely sent to the extraction step d). The distillate fraction containing diesel may optionally be sent partly to the hydrocracking step e).

At least part, and preferably all, of the vacuum residue fraction 5 is sent to the deasphalting step c).

At least part, and preferably all, of the vacuum distillate fraction 11 is sent to the aromatics extraction step d).

Deasphalting Step c)

In accordance with the invention, the process comprises a step c) of deasphalting by liquid-liquid extraction of the residue fraction 5 obtained from the separation step b). Said step c) is implemented by liquid-liquid extraction using a solvent or a mixture of solvents 6, enabling the production on the one hand of an asphalt-comprising fraction 7 and on the other hand of a deasphalted oil (DAO) fraction 8.

The deasphalting step c) is preferably performed under specific conditions which enable the production of a DAO 8 of quality, preferably with a low asphaltene content.

The deasphalting step c) is preferably performed in a single step by means of an apolar solvent or a mixture of apolar solvents.

Step c) may be performed in an extraction column or extractor, or in a mixer-decanter. Step c) is preferably performed in an extraction column containing liquid-liquid contactors (packing elements and/or plates, etc.) placed in one or more zones. Preferably, the solvent or the solvent mixture 6 is introduced into the extraction column at two different levels. Preferably, the deasphalting feedstock is introduced into an extraction column at only one introduction level, generally as a mixture with at least one portion of the solvent or of the solvent mixture 6 and generally below a first zone of liquid-liquid contactors. Preferably, the other part of the solvent or solvent mixture 6 is injected lower than the deasphalting feedstock, generally below a second zone of liquid-liquid contactors, the deasphalting feedstock being injected above this second zone of contactors.

Step c) is performed under subcritical conditions, in other words below the critical point, for said solvent or solvent mixture 6. Step c) is performed at a temperature advantageously between 50 and 350° C., preferably between 80 and 320° C., more preferably between 120 and 310° C. and even more preferably between 150 and 300° C., and at a pressure advantageously between 0.1 and 6 MPa, preferably between 1 and 6 MPa and more preferably between 2 and 5 MPa.

The ratio of the volume of solvent or solvent mixture 6 to the mass of residue fraction 5 obtained from step b) is generally between 1/1 and 12/1, preferably between 2/1 and 9/1 expressed in litres per kilogram. This ratio includes all of the solvent or mixture of solvents, which may be divided into several injection points.

The apolar solvent used is preferably a solvent composed of saturated hydrocarbon(s) comprising a carbon number of greater than or equal to 3, preferably of between 3 and 5. These solvents may for example be propane, butane or pentane. These solvents are utilized pure or as a mixture.

The solvent 6 used in step c) is preferably an apolar solvent composed of at least 80% by volume of saturated hydrocarbon(s) comprising a carbon number of between 3 and 7, preferably of between 4 and 5, so as to maximize the yield of DAO fraction 8.

The choice of the temperature and pressure conditions for the extraction combined with the choice of the nature of the solvents 6 in the deasphalting step c) make it possible to adjust the extraction performance. Step c) may make it possible, by virtue of these specific deasphalting conditions, to precipitate, from the asphalt fraction 7, an adjusted amount of polar structures of heavy resin and asphaltene type, thereby making it possible to obtain an asphalt fraction 7 in a moderate yield, generally less than 40%, or even less than 30% relative to the amount of compounds with a boiling point of greater than 540° C. at the entry to the deasphalting step c). The high yield of DAO 8 enables the production of more cracked products at the exit from the steam cracking step g). The resulting DAO fraction 8 comprises less than 2000 ppm of C7 asphaltenes, generally less than 1000 ppm of C7 asphaltenes, or even less than 500 ppm of C7 asphaltenes.

A fraction which comprises the DAO 8 and a portion of the solvent or of the solvent mixture is recovered at the top of the extraction column or of the mixer-decanter, preferably above the highest-positioned liquid-liquid contactor zone.

A fraction 7 which comprises the asphalt and some of the solvent or mixture of solvents is recovered at the bottom of the extraction column or of the mixer-decanter, preferably below the lowest-positioned contactor zone.

The solvent or solvent mixture 6 may consist of a top-up and/or of a portion recycled during separation steps. These top-ups advantageously enable compensation of the solvent losses in the asphalt fraction 7 and/or in the DAO fraction 8, resulting from the separation steps.

The deasphalting step c) comprises an integrated substep of separation of the fraction 8 comprising the DAO and the solvent or solvent mixture. The solvent or solvent mixture recovered can be recycled in the deasphalting step c). This integrated separation substep making it possible to separate the DAO 8 and the solvent or solvent mixture can use all the required equipment known to those skilled in the art (separating vessels, distillation or stripping columns, heat exchangers, ovens, pumps, compressors, etc.).

At least some, and preferably all, of the DAO 8 is sent to the aromatics extraction step d).

Aromatics Extraction Step d)

In accordance with the invention, the process comprises a step d) of extraction of the aromatics from at least some of the deasphalted oil fraction 8 obtained from the deasphalting step c). Said step enables the production of an extract fraction 13 and a raffinate fraction 10.

Advantageously, at least part, preferably all, of the distillate fraction comprising compounds with a boiling point of between 180 and 350° C., obtained from the separation step b), is also introduced into the aromatics extraction step d).

Optionally, part of the fraction 11 obtained from the separation step b) and comprising compounds with a boiling point of between 350 and 540° C. may be introduced into the extraction step d).

The objective of the aromatics extraction step is to extract at least partly the aromatic compounds, by liquid-liquid extraction by means of a polar solvent 9, and also the resins contained in the DAO fraction 8.

The extraction of the aromatics is preferably performed on fractions with a boiling point of greater than 180° C. and preferably greater than 350° C., so as to prevent losses of yield of light fractions during the recovery of the solvent after extraction.

The compounds extracted during step d) preferably have a boiling point greater than the boiling point of the solvent, thereby advantageously enabling maximization of the yield in the separation of the solvent from the raffinate after extraction. Moreover, the recovery of the solvent is also more efficient and economical.

The solvent used may be furfural, N-methyl-2-pyrrolidone (NMP), sulfolane, dimethylformamide (DMF), dimethyl sulfoxide (DMSO), phenol, or a mixture of these solvents in equal or different proportions. The solvent is preferably furfural.

The operating conditions are, in general, a ratio of solvent to step d) feedstock of 1/2 to 6/1, preferably of 1/1 to 4/1, a temperature profile of between the ambient temperature and 150° C., preferably between 50 and 150° C. The pressure is situated between atmospheric pressure and 2.0 MPa, preferably between 0.1 and 1.0 MPa.

The liquid/liquid extraction may generally be performed in a mixer-decanter or in an extraction column operating in counter-current mode. The extraction is preferably performed in an extraction column.

The solvent selected has a sufficiently high boiling point to fluidify the feedstock of step d) without being evaporated.

After the solvent has made contact with the effluent introduced in step d), two fractions are obtained at the end of step d): an extract fraction 13, consisting of the portions of the heavy fraction that are insoluble in the solvent (and are highly concentrated in aromatics), and a raffinate fraction 10, which consists of the solvent and the soluble portions of the heavy fraction. The solvent is separated by distillation from the soluble portions and recycled internally to the liquid/liquid extraction process. The separation of the extract and the raffinate and the recovery of the solvent are performed in a separation substep integrated into the aromatics extraction step d).

Fixed-Bed Hydrocracking Step e)

In accordance with the invention, the process comprises a step e) of fixed-bed hydrocracking of at least some of the fraction 11 obtained from the separation step b) and of at least some of the extract fraction 13 obtained from the extraction step d), in the presence of a hydrocracking catalyst.

Hydrogen 12 can also be injected upstream of the various catalytic beds making up the hydrocracking reactor(s). In parallel with the hydrocracking reactions desired in this step, any type of hydrotreatment reaction (HDM, HDS, HDN, etc.) also takes place. Hydrocracking reactions resulting in the formation of atmospheric distillates take place with a degree of conversion of the vacuum distillate into atmospheric distillate which is generally greater than 30%, typically between 30% and 50% for mild hydrocracking and greater than 80% for advanced hydrocracking. Specific conditions, in particular temperature conditions, and/or the use of one or more specific catalysts, make it possible to promote the desired hydrocracking reactions.

The hydrocracking step e) according to the invention is performed under hydrocracking conditions. It may advantageously be implemented at a temperature of between 340° C. and 480° C., preferably between 350° C. and 430° C., and under an absolute pressure of between 5 and 25 MPa, preferably between 8 and 20 MPa, more preferably between 10 and 18 MPa. The temperature is usually adjusted according to the desired level of hydrotreating and the intended duration of the treatment. Most often, the space velocity of the hydrocarbon feedstock, commonly referred to as HSV, which is defined as being the volumetric flow rate of the feedstock divided by the total volume of the catalyst, may be within a range from 0.1 to 3.0 $h^{-1}$, preferably from 0.2 to 2.0 $h^{-1}$, and more preferably from 0.25 to 1.0 $h^{-1}$. The amount of hydrogen mixed with the feedstock may be between 100 and 5000 normal cubic metres ($Nm^3$) per cubic metre ($m^3$) of liquid feedstock, preferably between 200 and 2000 $Nm^3/m^3$, and more preferably between 300 and 1500 $Nm^3/m^3$. The hydrocracking step e) can be performed industrially in at least one reactor having a downward liquid flow.

The hydrocracking step e) preferably comprises two catalytic sections in series, with an upstream hydrotreating catalytic section so as to limit the deactivation of the downstream hydrocracking catalytic section. This hydrotreating section aims in particular to significantly reduce the nitrogen content of the feedstock, nitrogen being an inhibitor of the acid function of the bifunctional catalysts of the hydrocracking catalytic section. The hydrocracking step e) may also comprise a second hydrocracking catalytic section treating at least one heavy cut resulting from a separation step.

The catalysts in the hydrocracking step e) that are used may be hydrotreating and hydrocracking catalysts.

The hydrotreating catalysts used may be hydrotreating catalysts consisting of a support of inorganic oxide type (preferably an alumina) and of an active phase comprising chemical elements from group VIII (Ni, Co, etc.) and group VI (Mo, etc.).

The hydrocracking catalysts may advantageously be bifunctional catalysts, having a hydrogenating phase in order to be able to hydrogenate the aromatics and produce the equilibrium between the saturated compounds and the corresponding olefins, and an acid phase enabling promotion of the hydroisomerization and hydrocracking reactions. The acid function is advantageously provided by supports having large surface areas (generally 100 to 800 $m^2 \cdot g^{-1}$) having surface acidity, such as halogenated (in particular chlorinated or fluorinated) aluminas, combinations of boron and aluminium oxides, amorphous silicas/aluminas and zeolites. The hydrogenating function is advantageously contributed either by one or more metals from group VIII of the Periodic Table of the Elements, such as iron, cobalt, nickel, ruthenium, rhodium, palladium, osmium, iridium and platinum, or by a combination of at least one metal from group VIB of the Periodic Table, such as molybdenum and tungsten, and at least one non-noble metal from group VIII (such as nickel and cobalt). Preferably, the bifunctional catalyst used comprises at least one metal chosen from the group formed by the metals of groups VIII and VIB, taken alone or as a mixture, and a support comprising 10% to 90% by weight of a zeolite and 90% to 10% by weight of inorganic oxides. The metal from group VIB that is used is preferably chosen from tungsten and molybdenum, and the metal from group VIII is preferably chosen from nickel and cobalt. According to another preferred variant, monofunctional catalysts and bifunctional catalysts of alumina, amorphous silica-alumina or zeolitic type can be used as a mixture or in successive layers.

Preferably, the catalytic volume used during the second hydrocracking step e) consists of at least 30% of hydrocracking catalysts of bifunctional type.

Optionally, a co-feedstock (not shown) can be injected upstream of any catalytic bed of the hydrocracking section d). This co-feedstock is typically a vacuum distillate resulting from direct distillation or resulting from a conversion process, or a deasphalted oil.

The hydrocracking step e) is preferably operated in "maxi naphtha" mode, meaning that it enables the production of a yield of liquid compounds with a boiling point of less than 220° C. of more than 50% by weight of the feedstock at the entry to the hydrocracking step e).

The effluent 14 obtained from the fixed-bed hydrocracking step e) is sent to a separation step f).

Step f) of Separation of the Fixed-Bed Hydrocracking Effluent

In accordance with the invention, the process further comprises a step f) of separating the effluent 14 obtained from the fixed-bed hydrocracking step e) into at least one gaseous fraction 15 and at least one liquid fraction 16.

Said effluent 14 is advantageously separated in at least one separating vessel into at least one gaseous fraction 15 and at least one liquid fraction 16. The step of separating said effluent 14 may be performed by means of any separating devices known to those skilled in the art, such as one or more separating vessels, which may operate at different pressures and temperatures, optionally in combination with a hydrogen or steam stripping means and with one or more distillation columns. These separators can, for example, be high-pressure high-temperature (HPHT) separators and/or high-pressure low-temperature (HPLT) separators.

The gaseous fraction 15 obtained at the end of the separation step e) comprises gases, such as $H_2$, $H_2S$, $NH_3$, and C1-C4 hydrocarbons (such as methane, ethane, propane and butane). Advantageously, the hydrogen contained in the gaseous fraction 15 is purified and recycled into any of the ebullated-bed hydroconversion steps a) and/or fixed-bed hydrocracking steps e). In a particular embodiment, the hydrogen contained in the gaseous fraction 15 may be purified simultaneously with the treatments of the gaseous fractions obtained from the separation of the effluents from the ebullated-bed hydroconversion steps a) and fixed-bed hydrocracking steps e). The hydrogen may be purified by washing with amines, by a membrane, by a PSA (Pressure Swing Adsorption) system, or by two or more of these means disposed in series.

In a preferred embodiment, the separation step f), in addition to the gas-liquid separation or the succession of separation devices, comprises at least one atmospheric distillation, in which the liquid hydrocarbon fraction(s) obtained after separation are fractionated by atmospheric distillation into at least one atmospheric distillate fraction 16, including compounds with a boiling point of less than 350° C., and optionally a liquid fraction comprising vacuum distillate, including compounds with a boiling point of greater than 350° C. At least some and preferably all of the atmospheric distillate fraction 16 and optionally of the fraction comprising vacuum distillate is advantageously sent to the steam cracking step g).

Optionally, at least some of the vacuum distillate fraction is recycled into the hydrocracking step e) and, according to this variant, it may be necessary to perform a purge consisting of unconverted vacuum distillate fractions, so as to deconcentrate the polyaromatic species and to limit the deactivation of the hydrocracking catalyst of step e). In order to limit the purge and thus increase the overall conversion, it may be advantageous to perform this purge, optionally, by sending at least some of the unconverted vacuum distillate fraction to the entry of the deasphalting step c), so as to at least partly remove the polyaromatic species in the asphalt fraction 7.

Steam Cracking Step g)

In accordance with the invention, the process comprises a step g) of steam cracking of the raffinate fraction 10 obtained from the extraction step d) and of the liquid fraction 16 obtained from the separation step f), including compounds with a boiling point of less than 350° C., and preferably a fraction comprising compounds with a boiling point of greater than 350° C., obtained from the separation step f).

Some of the fraction comprising compounds with a boiling point of between 80 and 180° C., obtained from the separation step b), may optionally be introduced into the steam cracking step g).

The steam cracking step g) is advantageously performed in at least one pyrolysis furnace at a temperature of between 700 and 900° C., preferably between 750 and 850° C., and under a pressure of between 0.05 and 0.3 MPa relative. The residence time of the hydrocarbons is generally less than or equal to 1.0 second (noted as s), preferably between 0.1 and 0.5 s. Water vapour is advantageously introduced upstream of the steam cracking step g). The amount of water introduced is between 0.3 and 3.0 kg of water per kg of hydrocarbons at the entry to step g). Step g) is preferably performed in a plurality of parallel pyrolysis furnaces, so as to adapt the operating conditions to the various streams supplying the step g) and obtained from steps b), e), f) and h), and also to manage the tube decoking times. A furnace comprises one or more tubes disposed in parallel. A furnace may also denote a group of furnaces operating in parallel. Accordingly, one furnace may be dedicated to the cracking of ethane-rich fractions, another to propane- and butane-rich cuts, another to cuts comprising compounds with a boiling point of between 80 and 180° C., another to cuts comprising compounds with a boiling point of between 180 and 350° C., and another to cuts comprising compounds with a boiling point of greater than 350° C.

Step h) of Separation of the Steam Cracking Effluent

The process preferably comprises a step h) of separating the effluent 17 obtained from the steam cracking step g), enabling the production of at least one fraction 18 comprising, preferably consisting of, hydrogen, a fraction 19 comprising, preferably consisting of, ethylene, a fraction 20 comprising, preferably consisting of, propylene, and a fraction 21 comprising, preferably consisting of, pyrolysis oil. Optionally, the separation step h) enables recovery also of a fraction comprising, preferably consisting of, butenes and a fraction comprising, preferably consisting of, pyrolysis gasoline.

The cuts rich in saturated compounds obtained from the light gases or from the pyrolysis gasoline obtained from the separation step h) may preferably be recycled into the steam cracking step g), notably ethane and propane, so as to increase the yield of ethylene and propylene.

The pyrolysis oil fraction 21 may optionally be subjected to an additional step of separation so as to produce a number of fractions, for example a light pyrolysis oil comprising compounds with a boiling point of less than 350° C. and a heavy pyrolysis oil comprising compounds with a boiling point of greater than 350° C. The light pyrolysis oil may advantageously be injected upstream of the hydrocracking step d). The heavy pyrolysis oil may advantageously be injected upstream of the hydroconversion step a) and/or of the deasphalting step c). Advantageously, the separation of the fraction 21 into two fractions and the recycling of those fractions into one of steps a), c) or e) of the process allows the formation of olefins from heavy hydrocarbon feedstocks to be maximized.

EXAMPLE

The example below illustrates a particular implementation of the process according to the invention, without limiting the scope thereof.

The heavy hydrocarbon feedstock 1 treated in the process is a vacuum residue originating from the Middle East and having the properties indicated in Table 1.

TABLE 1

| Feedstock properties | | |
|---|---|---|
| Sulfur content | % m/m | 4.89 |
| Mass per unit volume | kg/m$^3$ | 1024 |
| C7 asphaltene content | % m/m | 12.6 |
| Ni + V content | ppm | 218 |
| Content of compounds boiling above 540° C. | % m/m | 82 |

The feedstock is subjected to a hydroconversion step a) in two ebullated-bed reactors in series and in the presence of an ebullated-bed hydroconversion catalyst such as NiMo on alumina, under the conditions indicated in Table 2.

TABLE 2

| Conditions of the ebullated-bed hydroconversion step a) | | |
|---|---|---|
| Temperature of reactors 1 and 2 | ° C. | 420 |
| Partial pressure of hydrogen | MPa abs | 16 |
| H2/HC (volume coverage of hydrogen relative to the feedstock volume) | Nm$^3$/m$^3$ | 1000 |

TABLE 2-continued

| Conditions of the ebullated-bed hydroconversion step a) | | |
|---|---|---|
| HSV of the reactors (volume flow rate of feedstock/volume of reactors) | h$^{-1}$ | 0.3 |

The effluent 3 obtained from the ebullated-bed hydroconversion step a) is subjected to a separation step b) involving separating vessels and also an atmospheric distillation column and a vacuum distillation column. The yields of the various fractions obtained after separation are indicated in Table 3 (mass % relative to the feedstock upstream of the ebullated-bed hydroconversion step a), noted as % m/m):

TABLE 3

| Yields of the hydroconversion step a) after separation in step b) | | |
|---|---|---|
| NH3 + H2S | % m/m | 4.1 |
| Fraction 4 (C1-C4) | % m/m | 3.7 |
| PI-180° C. | % m/m | 7.6 |
| Fraction (180-350° C.) | % m/m | 20.0 |
| Fraction 11 (350-540° C.) | % m/m | 33.4 |
| Fraction 5 (540° C.+) | % m/m | 32.4 |

Fraction 5 (540° C.+) of vacuum residue type is sent to a deasphalting step c) which is performed in an extraction column operating continuously, under the conditions presented in Table 4:

TABLE 4

| Conditions of the deasphalting step | | |
|---|---|---|
| Nature of solvent | — | n-Butane |
| Content of solvent relative to the deasphalting feedstock | v/v | 8/1 |
| Temperature at top of extractor | ° C. | 120 |
| Temperature at bottom of extractor | ° C. | 80 |
| Pressure at top of extractor | MPa abs | 4.1 |

On conclusion of the deasphalting step c), a DAO fraction 8 is obtained with a yield of 62%, and a pitch fraction is obtained with a yield of 38%; these yields are based on the feedstock of the deasphalting step, corresponding to fraction 5 (540° C.+) obtained from step b) of separation of the effluent from the hydroconversion step a).

The DAO fraction 8 obtained from the deasphalting step c), the fraction (180-350° C.) and the fraction 11 (350-540° C.) obtained from the separation step b) are sent to an aromatics extraction step d) which is performed in a mixer-decanter, the conditions for which are presented in Table 5:

TABLE 5

| Conditions of the extraction step d) | | |
|---|---|---|
| Nature of solvent | — | Furfural |
| Content of solvent relative to the extraction feedstock | v/v | 1.5/1 |
| Extraction temperature | ° C. | 110 |
| Extraction pressure | MPa abs | 0.5 |

On conclusion of the aromatics extraction step, an aromatics-depleted raffinate fraction 10 is obtained in a yield of 56.2%, and an aromatics-enriched extract fraction 13 is obtained in a yield of 43.8%; these yields are based on the total feedstock, i.e. all of the fractions introduced into the aromatics extraction step d).

The extract fraction 13 obtained from the aromatics extraction step d) is sent to a fixed-bed hydrocracking step e) performed under the conditions presented in Table 6:

TABLE 6

| Conditions of the fixed-bed hydrocracking step e) | | |
|---|---|---|
| Hydrotreating temperature | ° C. | 380 |
| Hydrocracking temperature | ° C. | 382 |
| Partial pressure of hydrogen | MPa abs | 16 |
| H2/HC (volume coverage of hydrogen relative to the feedstock volume) | $Nm^3/m^3$ | 1000 |
| HSV hydrotreating catalyst | $h^{-1}$ | 0.85 |
| HSV hydrocracking catalyst | $h^{-1}$ | 0.90 |
| Hydrotreating catalyst | NiMo on alumina | |
| Hydrocracking catalyst | NiW on alumina + zeolite | |

The effluent 14 obtained from the fixed-bed hydrocracking step e) is subjected to a separation step involving separating vessels and also an atmospheric distillation column. The yields of the various fractions obtained after separation are indicated in Table 7 (mass % relative to the feedstock upstream of the fixed-bed hydrocracking step, noted as % m/m):

TABLE 7

| Yields of the fixed-bed hydrocracking step e) after separation in step f) | | |
|---|---|---|
| NH3 + H2S | % m/m | 1.1 |
| C1-C4 | % m/m | 4.8 |
| PI-220° C. | % m/m | 63.7 |
| 220-350° C. | % m/m | 24.3 |
| 350° C.+ | % m/m | 8.4 |

The liquid fractions PI-220° C., 220-350° C. and 350° C.+ obtained from step f) of separation of the effluent from the fixed-bed hydrocracking step, the fraction PI-180° C. obtained from the ebullated-bed hydrocracking step a) and the raffinate fraction 10 obtained from the aromatics extraction step d) are sent to a steam cracking step g) in which each of the liquid fractions is cracked under various conditions (Table 8).

TABLE 8

| Conditions of the steam cracking step | | |
|---|---|---|
| Pressure at furnace exit | MPa abs | 0.2 |
| Temperature at furnace exit, fractions Pl-220° C. and PI-180° C. | ° C. | 800 |
| Temperature at furnace exit, fraction 220-350° C. | ° C. | 790 |
| Temperature at furnace exit, fractions 350° C.+ and raffinate | ° C. | 780 |
| Ratio of steam to fractions PI-220° C. and Pl-180° C. | kg/kg | 0.6 |
| Ratio of steam to fraction 220-350° C. | kg/kg | 0.8 |
| Ratio of steam to fractions 350° C.+ and raffinate | kg/kg | 1.0 |
| Furnace residence time, fractions PI-220° C. and PI-180° C. | S | 0.3 |
| Furnace residence time, fraction 220-350° C. | s | 0.3 |
| Furnace residence time, fractions 350° C.+ and raffinate | s | 0.3 |

The effluents from the various steam cracking furnaces are subjected to a separation step which enables recycling of the saturated compounds and the production of the yields indicated in Table 9 (mass % relative to the total feedstock upstream of the steam cracking step g), noted as % m/m).

TABLE 9

| Yields of the steam cracking step | | |
|---|---|---|
| H2, CO, C1 | % m/m | 8.0 |
| Ethylene | % m/m | 34.4 |
| Propylene | % m/m | 18.7 |
| C4 cut | % m/m | 14.9 |
| Pyrolysis gasoline | % m/m | 19.2 |
| Pyrolysis oil | % m/m | 4.8 |

Table 9 presents the yields of steam cracking products. Relative to the atmospheric residue feedstock introduced into the hydroconversion step a), the process according to the invention enables mass yields of ethylene and of propylene of 29.4% and 16.0%, respectively, to be achieved. Furthermore, the specific sequence of steps upstream of the steam cracking step enables the limitation of coking.

The invention claimed is:

1. A process for producing olefins from a hydrocarbon feedstock (1) with a sulfur content of at least 0.1 weight %, an initial boiling point of at least 180° C. and a final boiling point of at least 600° C., said process comprising:

a) a hydroconversion step performed in an ebullated-bed reactor, in which said heavy hydrocarbon feedstock (1) is contacted, in the presence of hydrogen (2), with a hydroconversion catalyst, said step enabling production of an effluent (3);

b) a step of separation of the effluent (3) obtained from hydroconversion step a) into a gaseous fraction (4), a fraction (11) comprising compounds with a boiling point of between 350 and 540° C., and a liquid vacuum residue fraction (5) comprising compounds with a boiling point of at least 540° C., c) a deasphalting step by liquid-liquid extraction of the vacuum residue fraction (5) obtained from separation step b), step c) being implemented by means of a solvent (6) or a mixture of solvents, enabling production of an asphalt-comprising fraction (7) and a deasphalted oil fraction (8), d) a step of extraction of aromatics from at least part of the deasphalted oil fraction (8) obtained from deasphalting step c), and from at least part of the fraction (11) obtained from separation step b), enabling production of an extract fraction (13) and a raffinate fraction (10), e) a step of fixed-bed hydrocracking of at least part of the extract fraction (13) obtained from step d) in the presence of hydrogen (12) and a hydrocracking catalyst, enabling production of hydrocracking effluent (14), f) a step of separation of the hydrocracking effluent (14) obtained from the fixed-bed hydrocracking step e) into at least one hydrocracked gaseous fraction (15) and at least one hydrocracked liquid fraction (16), g) a step of steam cracking of the raffinate fraction (10) obtained from extraction step d) and of the hydrocracked liquid fraction (16) obtained from separation step f), including compounds with a boiling point of less than 350° C., enabling production of a steam-cracked effluent (17), h) a step of separation of the steam-cracked effluent (17) obtained from the steam cracking step g), enabling production of at least one hydrogen-comprising fraction (18), an ethylene-comprising fraction (19), a propylene-comprising fraction (20), and a fraction (21) comprising pyrolysis oil.

2. The process according to claim 1, wherein separation step b) comprises a vacuum distillation.

3. The process according to claim 2, wherein separation step b) comprises, upstream of the vacuum distillation, an atmospheric distillation, enabling production of at least one atmospheric distillate fraction and at least one atmospheric residue fraction, said atmospheric residue fraction being sent into said vacuum distillation.

4. The process according to claim 1, wherein all of the residue fraction (5) obtained from step b) is sent to the deasphalting step c).

5. The process according to claim 1, wherein the solvent (6) used in step c) is an apolar solvent composed of at least 80% by volume of saturated hydrocarbon(s) comprising a carbon number of between 3 and 7.

6. The process according to claim 3, wherein at least part of the fraction (11) comprising compounds with a boiling point of between 350 and 540° C. obtained from the separation step b) is introduced into extraction step d).

7. The process according to claim 1, wherein extraction step d) is performed on fractions (8, 11) with a boiling point of greater than 180° C.

8. The process according to claim 1, wherein compounds extracted (10, 13) during step d) have a boiling point greater than the boiling point of said solvent (6) or a mixture of solvents.

9. The process according to claim 1, wherein hydrocracking step e) produces a yield of liquid compounds with a boiling point of less than 220° C. of more than 50% by weight of the feedstock entering the hydrocracking step e).

10. The process according to claim 1, wherein separation step f) comprises at least one atmospheric distillation, enabling production of at least one atmospheric distillate fraction, that includes compounds with a boiling point of less than 350° C., and a liquid fraction comprising vacuum distillate including compounds with a boiling point of greater than 350° C.

11. Process according to claim 10, wherein the at least one atmospheric distillate fraction and the liquid fraction comprising vacuum distillate are sent to steam cracking step g).

12. The process according to claim 1, wherein part of a fraction comprising compounds with a boiling point between 80 and 180° C. obtained from separation step b) is introduced into steam cracking step g).

13. The process according to claim 1, wherein steam cracking step g) is performed in at least one pyrolysis furnace at a temperature of between 700 and 900° C., under a pressure of between 0.05 and 0.3 MPa, and for a residence time of less than or equal to 1.0 second.

14. The process according to claim 1, wherein separation step h) further produces a pyrolysis gasoline fraction, and wherein cuts rich in saturated compounds obtained from at least one hydrogen-comprising fraction obtained from separation step (h) or from the pyrolysis gasoline fraction obtained from separation step h) are recycled into steam cracking step g).

15. The process according to claim 1, wherein the fraction comprising pyrolysis oil (21) is subjected to an additional separation step to obtain a light pyrolysis oil, comprising compounds with a boiling point of less than 350° C., and a heavy pyrolysis oil, comprising compounds with a boiling point of greater than 350° C., and said light pyrolysis oil is injected upstream of hydrocracking step e) and said heavy pyrolysis oil is injected upstream of hydroconversion step a) and/or of the deasphalting step c).

* * * * *